US007755591B2

(12) United States Patent
Yeh

(10) Patent No.: US 7,755,591 B2
(45) Date of Patent: Jul. 13, 2010

(54) DISPLAY PANEL AND DEVICE UTILIZING THE SAME AND PIXEL STRUCTURE

(75) Inventor: Tsung-Lin Yeh, Taoyuan County (TW)

(73) Assignee: AU Optronics Corp., Hsinchu (TW)

( * ) Notice: Subject to any disclaimer, the term of this patent is extended or adjusted under 35 U.S.C. 154(b) by 744 days.

(21) Appl. No.: 11/563,708

(22) Filed: Nov. 28, 2006

(65) Prior Publication Data

US 2007/0176874 A1 Aug. 2, 2007

(30) Foreign Application Priority Data

Jan. 27, 2006 (TW) ..... 95103470 A

(51) Int. Cl.
*G09G 3/36* (2006.01)

(52) U.S. Cl. ..... 345/100; 345/98; 345/211

(58) Field of Classification Search ..... 345/87–102, 345/211, 214, 690

See application file for complete search history.

(56) References Cited

U.S. PATENT DOCUMENTS

| | | | | |
|---|---|---|---|---|
| 5,990,629 | A | 11/1999 | Yamada et al. | |
| 6,028,577 | A | 2/2000 | Sakamoto | |
| 6,707,441 | B1 * | 3/2004 | Hebiguchi et al. | 345/92 |
| 2005/0225523 | A1 * | 10/2005 | Park | 345/87 |

FOREIGN PATENT DOCUMENTS

| | | |
|---|---|---|
| CN | 1357872 | 7/2002 |
| JP | 2004126199 | 4/2004 |
| TW | 200539096 | 5/1993 |
| TW | 491959 | 6/2002 |
| TW | 441136 | 6/2006 |

OTHER PUBLICATIONS

China Office Action mailed Jun. 8, 2007.
English language translation of abstract of TW 491959 (published Jun. 21, 2002).
English language translation of abstract of TW 200539096.
English language translation of abstract of TW 441136 (published Jun. 16, 2001).

* cited by examiner

*Primary Examiner*—Duc Q Dinh
(74) *Attorney, Agent, or Firm*—Thomas, Kayden, Horstemeyer & Risley

(57) ABSTRACT

A display panel includes a first row line, a second row line, a first column line, a first transistor, and a second transistor. The second row line is parallel to the first row line. The first column line is vertical to the first row line and the second row line. The first transistor includes a first terminal, a second terminal, and a first control terminal coupled to the first row line. The second transistor includes a third terminal coupled to the first column line, a fourth terminal coupled to the first terminal, and a second control terminal coupled to the second row line.

22 Claims, 7 Drawing Sheets

DISPLAY PANEL AND DEVICE UTILIZING THE SAME AND PIXEL STRUCTURE

BACKGROUND OF THE INVENTION

1. Field of the Invention

The invention relates to a display panel, and in particular to a display panel with a plurality of pixel units.

2. Description of the Related Art

FIG. 1 is a schematic diagram of a conventional display panel. The display panel 10 comprises gate lines $G_1$~$G_n$, source lines $S_1$~$S_m$, and pixel units $P_{11}$~$P_{mn}$. Each set of one gate line and one source line intersecting to each other is used to control a pixel unit. For example, the gate line $G_1$ and source line $S_1$ intersect to each other and control the pixel unit $P_{11}$.

The equivalent circuit of the pixel units comprises the transistors $T_{11}$~$T_{mn}$, the storage capacitors $Ccs_{11}$~$Ccs_{mn}$, and the liquid crystal capacitors $Clc_{11}$~$Clc_{mn}$. Such a connection can turn all the transistors on the same line (i.e. positioned on the same gate line) on or off using a scan signal, such that the video signals are written into the corresponding pixel units through source lines.

Taking a 1024×768 display panel as an example, since each pixel unit comprises three sub-pixels (R, G and B sub-pixels), the display panel needs 1024×3 source lines for controlling all the pixel units.

The number of the pixel units is directly proportional to the resolution of display panel. When the resolution of the display panel is higher, the numbers of the pixel units and the source lines as well are required to be increased.

Display panel 10 comprises various source drivers (not shown), each controlling a plurality of source lines. When the number of the source lines is increased, not only the aperture ratio of display panel 10 is reduced but also the number of source drivers is increased, causing the higher cost and volume of the display panel 10 and the smaller usable area space of the display panel 10.

BRIEF SUMMARY OF THE INVENTION

Display panels are provided. An exemplary embodiment of a display panel comprises a first row line, a second row line, a first column line, a first transistor and a second transistor. The second row line is parallel to the first row line. The first column line is vertical to the first row line and the second row line. The first transistor comprises a first terminal, a second terminal, and a first control terminal coupled to the first row line. The second transistor comprises a third terminal coupled to the first column line, a fourth terminal coupled to the first terminal, and a second control terminal coupled to the second row line.

Display devices are also provided. An exemplary embodiment of a display device comprises a row driving unit, a column driving unit, and a display panel. The row driving unit provides a first row signal and a second row signal. The column driving unit provides a first column signal. The display panel comprises a first row line, a second row line, a first column line, a first transistor, and a second transistor. The first row line receives the first row signal. The second row line is parallel to the first row line and receives the second row signal. The first column line is vertical to the first row line and the second row line, and receives the first column signal. The first transistor comprises a first terminal, a second terminal, and a first control terminal coupled to the first row line. The second transistor comprises a third terminal coupled to the first column line, a fourth terminal coupled to the first terminal, and a second control terminal coupled to the second row line.

Pixel structures are also provided. An exemplary embodiment of a pixel structure comprises a first row line, a second row line, a third row line, a first column line, a first transistor, a second transistor, a third transistor, and a fourth transistor. The second row line is parallel to the first row line. The third row line is parallel to the first row line. The first column line is vertical to the first row line and the second row line. The first transistor comprises a first terminal, a second terminal, and a first control terminal coupled to the first row line. The second transistor comprises a third terminal coupled to the first column line, a fourth terminal coupled to the first terminal, and a second control terminal coupled to the second row line. The third transistor comprises a fifth terminal, a sixth terminal, and a third control terminal coupled to the second row line. The fourth transistor comprises a seventh terminal coupled to the first column line, an eighth terminal coupled to the fifth terminal, and a fourth control terminal coupled to the third row line. During a first period, the first row line and the second row line are simultaneously enabled and a first data signal is transmitted to the first transistor and the second transistor through the first column line. During a second period, the second row line is enabled and a second data is transmitted to the second transistor through the first column line. During a third period, the second row line and the third row line are simultaneously enabled and a third data signal is transmitted to the second transistor, the third transistor, and the fourth transistor through the first column line. During a fourth period, the third row line is enabled and a fourth data is transmitted to the fourth transistor through the first column line. During a fifth period, the second row line is enabled and a fifth data is transmitted to the second transistor through the first column line.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, where.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
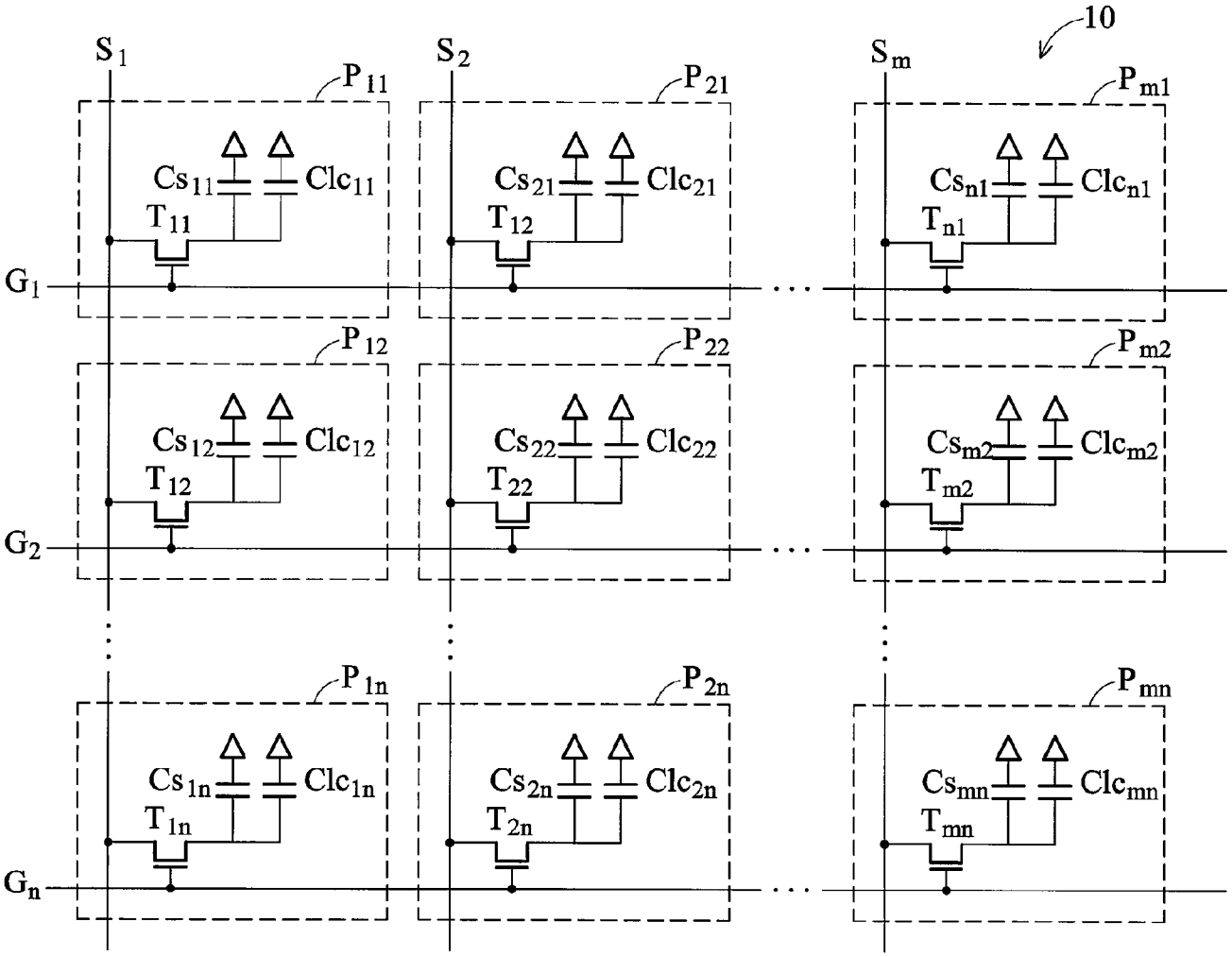
FIG. 1 (RELATED ART)
FIG. 1 is a schematic diagram of a conventional display panel.
Figure 2:
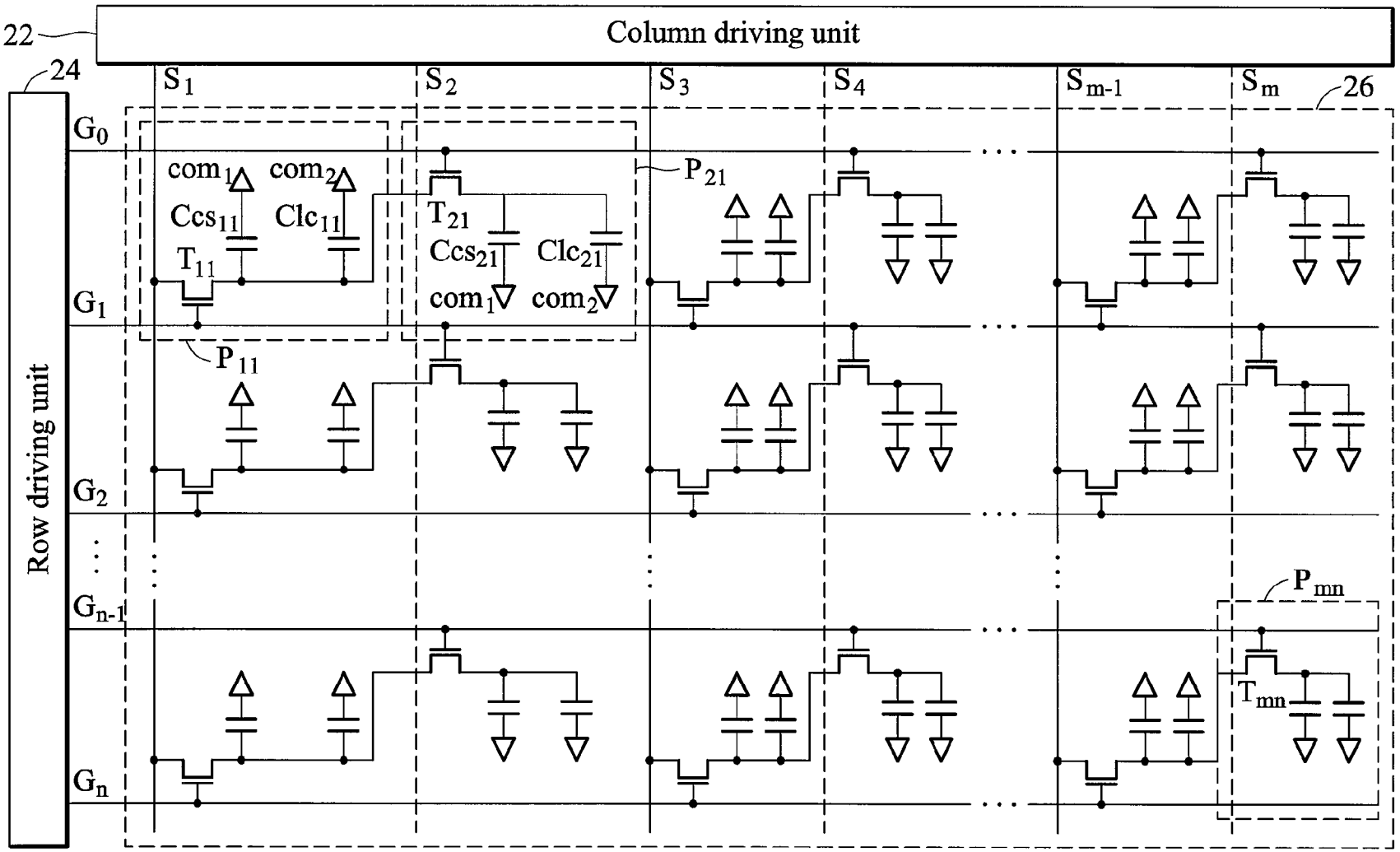
FIG. 2 is a schematic diagram of an exemplary embodiment of a display device, according to the present invention.

FIG. 2 is a schematic diagram of an exemplary embodiment of a display device, according to the present invention. The display device comprises a column driving unit 22, a row driving unit 24, and a display panel 26. The column driving unit 22 provides a plurality of column signals, such as a plurality of data signals, and the row driving unit 24 provides a plurality of row signals, such as a plurality of scan signals. The display panel 26 comprises the gate lines (row lines) G0~Gn for receiving the row signals, the source lines (column line) S1~Sm-1 for receiving the column signals, and the pixel units P11~Pmn.

In this embodiment, the even source lines (shown by dashed lines in FIG. 2) are omitted. Each of the transistors originally coupled to an even source line is changed to couple with one transistor of a neighboring pixel unit. If the two adjacent transistors coupled to the same source line are coupled to two different gate lines, respectively.

For clarity, only the pixel units $P_{11}$ and $P_{21}$ are shown and given as an example. The pixel unit $P_{11}$ comprises a transistor $T_{11}$, a storage capacitor $Ccs_{11}$, a liquid crystal capacitor $Clc_{11}$, and the pixel unit $P_{21}$ comprises a transistor $T_{21}$, a storage capacitor $Ccs_{21}$, and a liquid crystal capacitor $Clc_{21}$.

Since the source and drain of a transistor are determined according to the direction of current, the two terminals of the transistor are represented by "source/drain" or "drain/source."

A source/drain of the transistor $T_{11}$ is coupled to the source line $S_1$. A gate of the transistor $T_{11}$ is coupled to the gate line $G_1$. The storage capacitor $Ccs_{11}$ is coupled between a drain/source of the transistor $T_{11}$ and a common line $com_1$. The liquid crystal capacitor $Clc_{11}$ is coupled between the drain/source of the transistor $T_{11}$ and a common line $com_2$. The level of the common line $com_1$ differs from that of the common line $com_2$.

A source/drain of the transistor $T_{21}$ is coupled to the drain/source of the transistor $T_{11}$. A gate of the transistor $T_{21}$ is coupled to the gate line $G_0$. The storage capacitor $Ccs_{21}$ is coupled between a drain/source of the transistor $T_{21}$ and the common line $com_1$. The liquid crystal capacitor $Clc_{21}$ is coupled between the drain/source of the transistor $T_{21}$ and the common line $com_2$.

Figure 3:
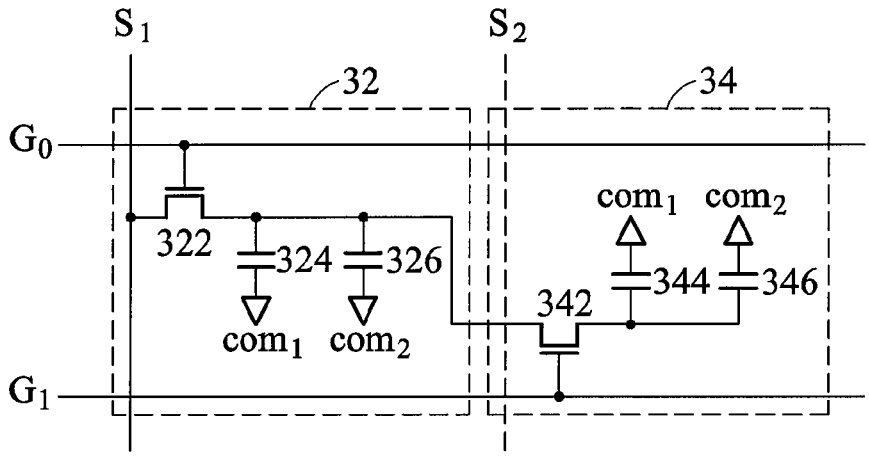
FIGS. 3 to 9 are schematic diagrams of another exemplary embodiment of a display device, according to the present invention.

FIG. 3 is a schematic diagram of another exemplary embodiment of a display device, according to the present invention. For clarity, only adjacent pixel units 32 and 34 are shown. A source/drain of the transistor 322 is coupled to the source line $S_1$. A gate of the transistor 322 is coupled to the gate line $G_0$. Transistor 342 comprises a source/drain coupled to a drain/source of the transistor 322, a drain/source, and a gate coupled to the gate line $G_1$. The storage capacitor 324 is coupled between the drain/source of the transistor 322 and the common line $com_1$. The liquid crystal capacitor 326 is coupled between the drain/source of the transistor 322 and the common line $com_2$. The storage capacitor 344 is coupled between the drain/source of the transistor 342 and the common line $com_1$. The liquid crystal capacitor 346 is coupled between the drain/source of the transistor 342 and the common line $com_2$.

Figure 4:
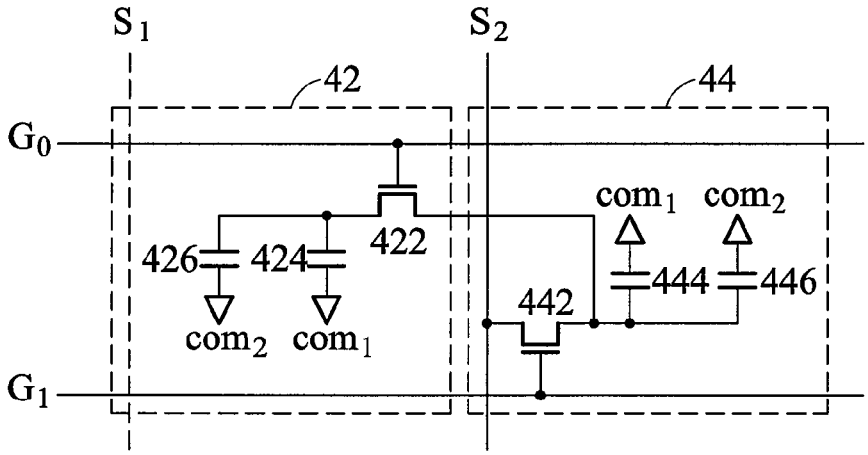

FIG. 4 is a schematic diagram of another exemplary embodiment of a display device. For clarity, only adjacent pixel units 42 and 44 are shown. A source/drain of the transistor 442 is coupled to the source line $S_2$. A gate of the transistor 442 is coupled to the gate line $G_1$. The transistor 422 comprises a source/drain coupled to a drain/source of the transistor 442, a drain/source, and a gate coupled to the gate line $G_0$. The storage capacitor 424 is coupled between the drain/source of the transistor 422 and the common line $com_1$. The liquid crystal capacitor 426 is coupled between the drain/source of the transistor 422 and the common line $com_2$. The storage capacitor 444 is coupled between the drain/source of the transistor 442 and the common line $com_1$. The liquid crystal capacitor 446 is coupled between the drain/source of the transistor 442 and the common line $com_2$.

Figure 5:
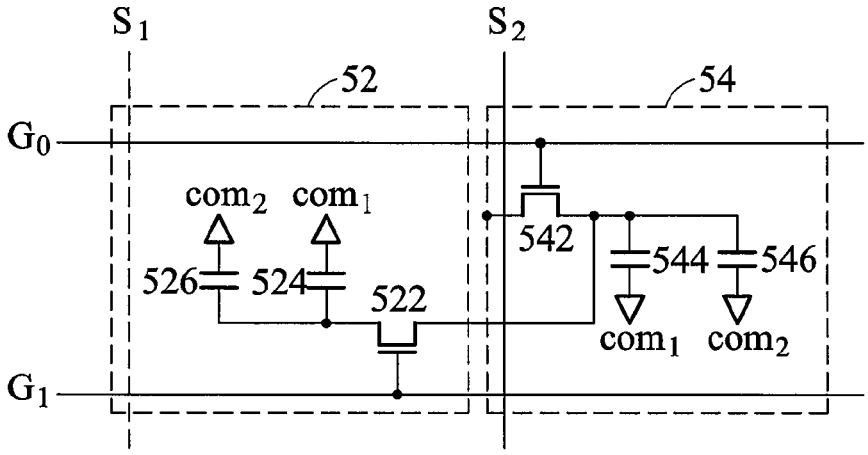

FIG. 5 is a schematic diagram of another exemplary embodiment of a display device. For clarity, only adjacent pixel units 52 and 54 are shown. A source/drain of the transistor 542 is coupled to the source line $S_2$. A gate of the transistor 542 is coupled to the gate line $G_0$. The transistor 522 comprises a source/drain coupled to a drain/source of the transistor 542, a drain/source, and a gate coupled to the gate line $G_1$. The storage capacitor 524 is coupled between the drain/source of the transistor 522 and the common line $com_1$. The liquid crystal capacitor 526 is coupled between the drain/source of the transistor 522 and the common line $com_2$. The storage capacitor 544 is coupled between the drain/source of the transistor 542 and the common line $com_1$. The liquid crystal capacitor 546 is coupled between the drain/source of the transistor 542 and the common line $com_2$.

Figure 6:
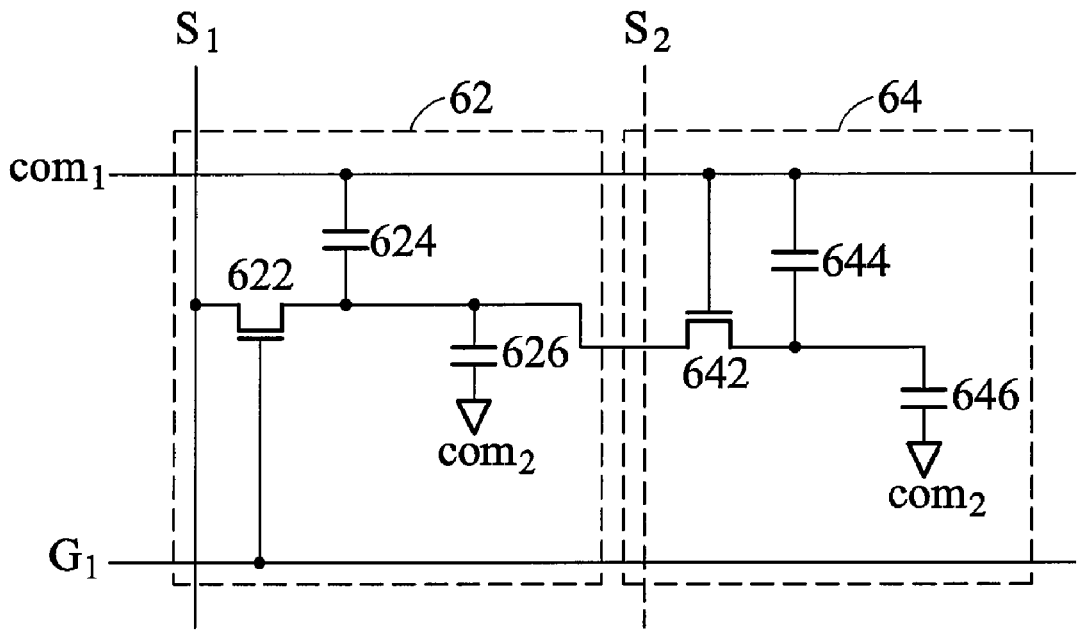

FIG. 6 is a schematic diagram of another exemplary embodiment of a display device, according to the present invention. For clarity, only adjacent pixel units 62 and 64 are shown. A source/drain of the transistor 622 is coupled to the source line $S_1$. A gate of the transistor 622 is coupled to the gate line $G_1$. Transistor 642 comprises a source/drain coupled to a drain/source of the transistor 622, a drain/source, and a gate coupled to the common line $com_1$. The storage capacitor 624 is coupled between the drain/source of the transistor 622 and the common line $com_1$. The liquid crystal capacitor 626 is coupled between the drain/source of the transistor 622 and the common line $com_2$. The storage capacitor 644 is coupled between the drain/source of the transistor 642 and the common line $com_1$. The liquid crystal capacitor 646 is coupled between the drain/source of the transistor 642 and the common line $com_2$.

Figure 7:
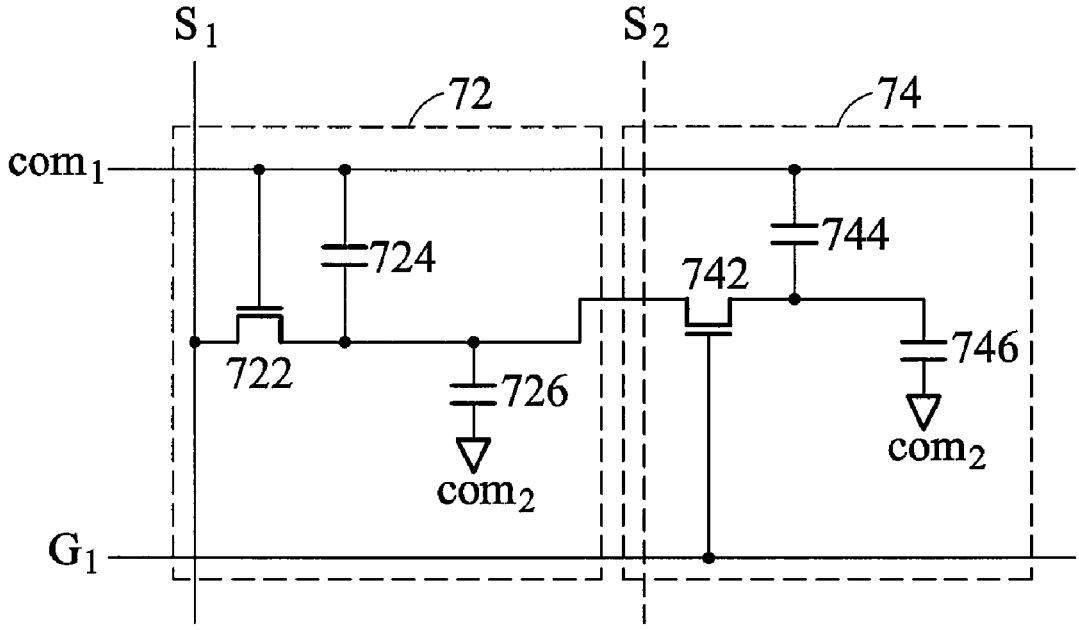

FIG. 7 is a schematic diagram of another exemplary embodiment of a display device, according to the present invention. For clarity, only adjacent pixel units 72 and 74 are shown. A source/drain of the transistor 722 is coupled to source line $S_1$. A gate of the transistor 722 is coupled to the common line $com_1$. The transistor 742 comprises a source/drain coupled to a drain/source of the transistor 722, a drain/source, and a gate coupled to the gate line $G_1$. The storage capacitor 724 is coupled between the drain/source of the transistor 722 and the common line $com_1$. The liquid crystal capacitor 726 is coupled between the drain/source of the transistor 722 and the common line $com_2$. The storage capacitor 744 is coupled between the drain/source of the transistor 742 and the common line $com_1$. The liquid crystal capacitor 746 is coupled between the drain/source of the transistor 742 and the common line $com_2$.

Figure 8:
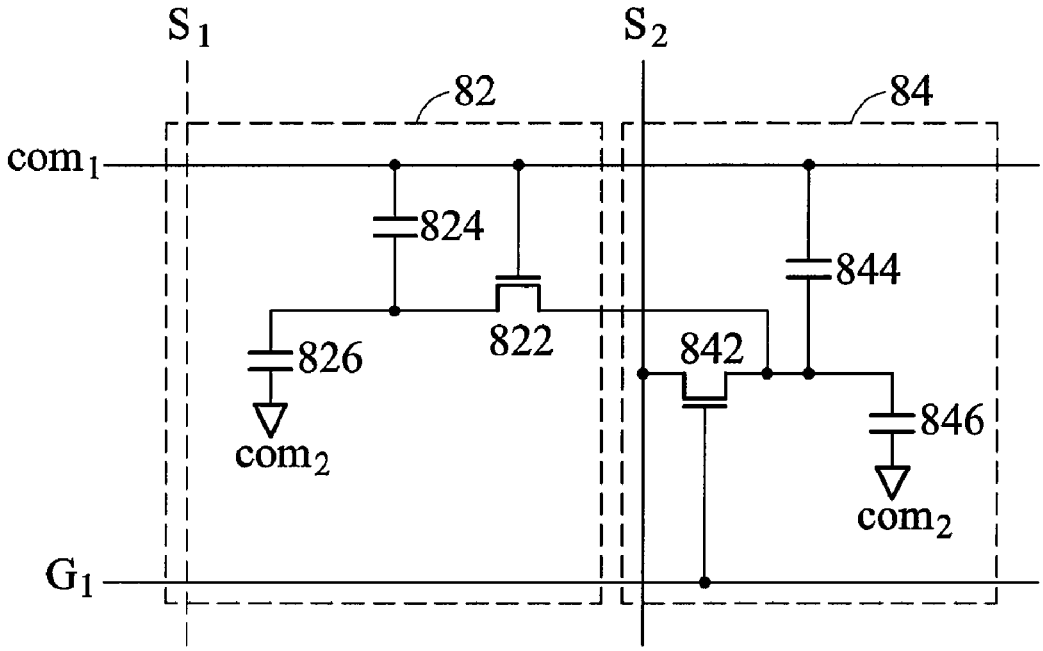

FIG. 8 is a schematic diagram of another exemplary embodiment of a display device, according to the present invention. For clarity, only adjacent pixel units 82 and 84 are shown. A source/drain of the transistor 842 is coupled to the source line $S_2$. A gate of the transistor 842 is coupled to the gate line $G_1$. The transistor 822 comprises a source/drain coupled to a drain/source of the transistor 842, a drain/source, and a gate coupled to the common line $com_1$. The storage capacitor 824 is coupled between the drain/source of the transistor 822 and the common line $com_1$. The liquid crystal capacitor 826 is coupled between the drain/source of the transistor 822 and the common line $com_2$. The storage capacitor 844 is coupled between the drain/source of the transistor 842 and the common line $com_1$. The liquid crystal capacitor 846 is coupled between the drain/source of the transistor 842 and the common line $com_2$.

Figure 9:
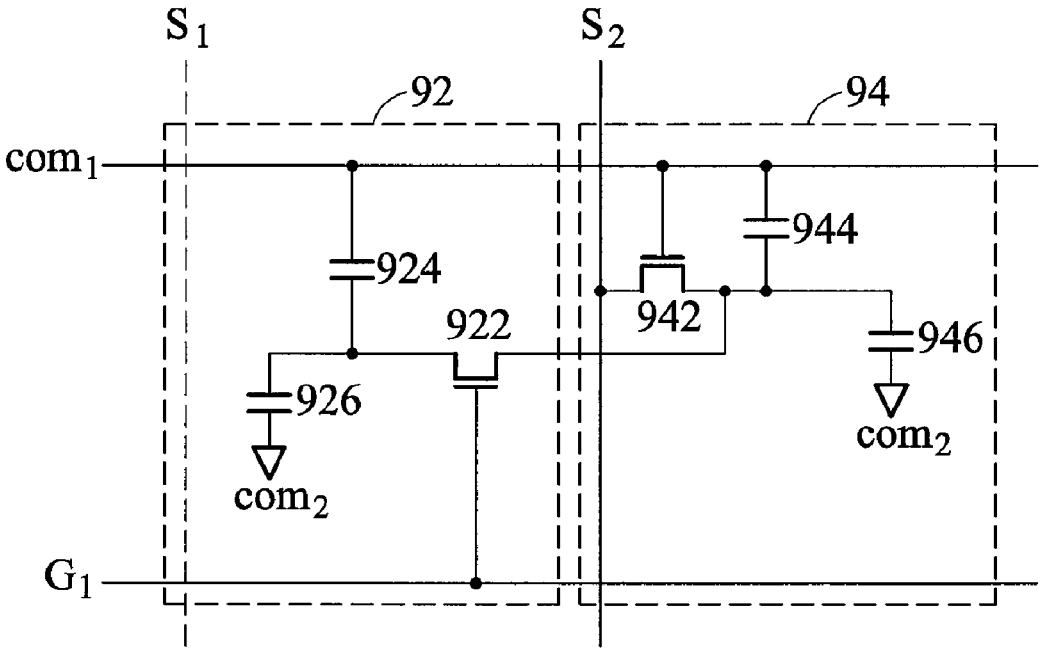

FIG. 9 is a schematic diagram of another exemplary embodiment of a display device, according to the present invention. For clarity, the only pixel units 92 and 94 are shown. A source/drain of the transistor 942 is coupled to the source line $S_2$. A gate of the transistor 942 is coupled to the common line $com_1$. The transistor 922 comprises a source/drain coupled to a drain/source of the transistor 942, a drain/source, and a gate coupled to the gate line $G_1$. The storage capacitor 924 is coupled between the drain/source of the transistor 922 and the common line $com_1$. The liquid crystal capacitor 926 is coupled between the drain/source of the transistor 922 and the common line $com_2$. The storage capacitor 944 is coupled between the drain/source of the transistor 942 and the common line $com_1$. The liquid crystal capacitor 946 is coupled between the drain/source of the transistor 942 and the common line $com_2$.

Figure 10:
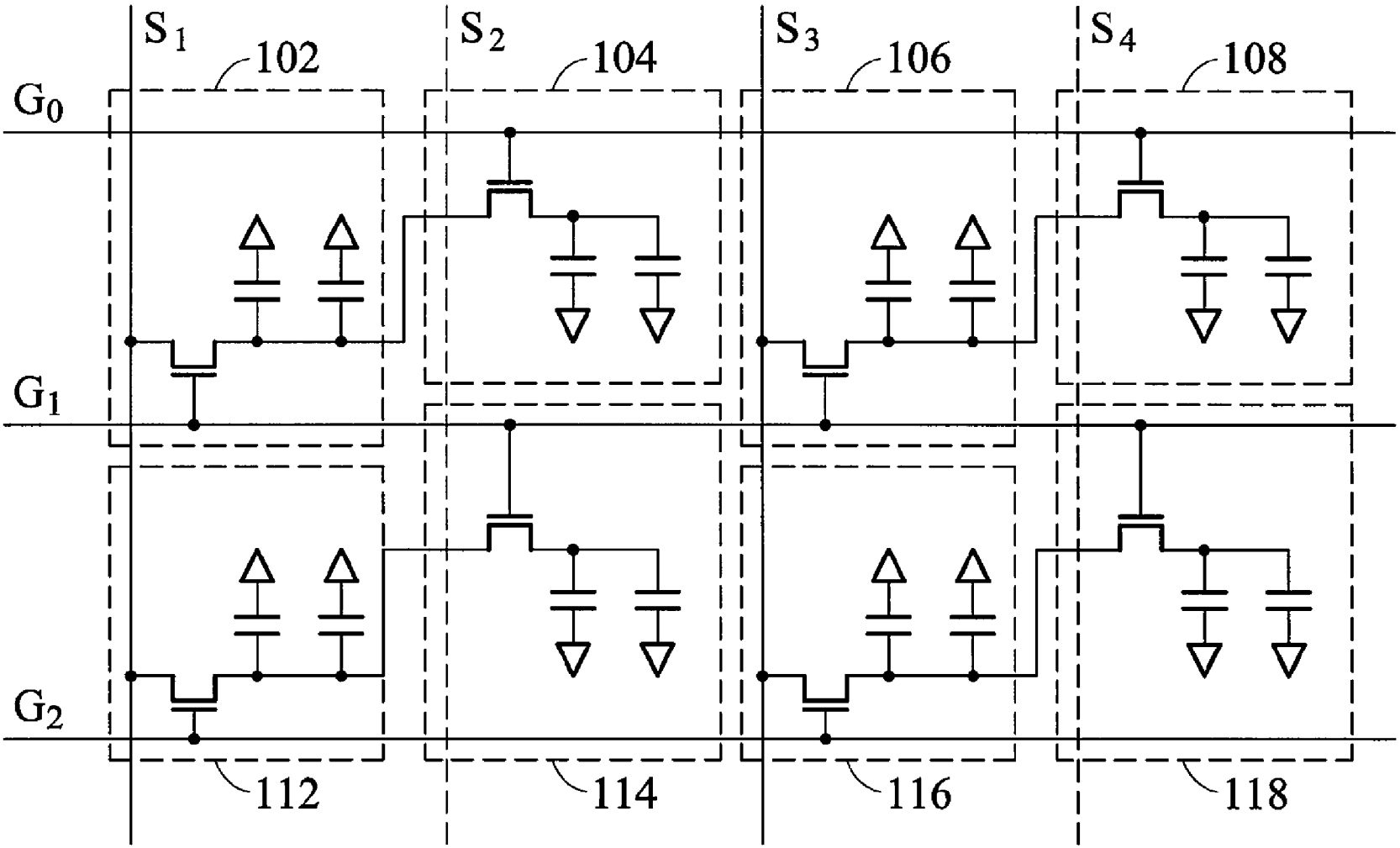
FIG. 10 is a schematic diagram of an exemplary embodiment of pixel units, according to the present invention.
Figure 11:
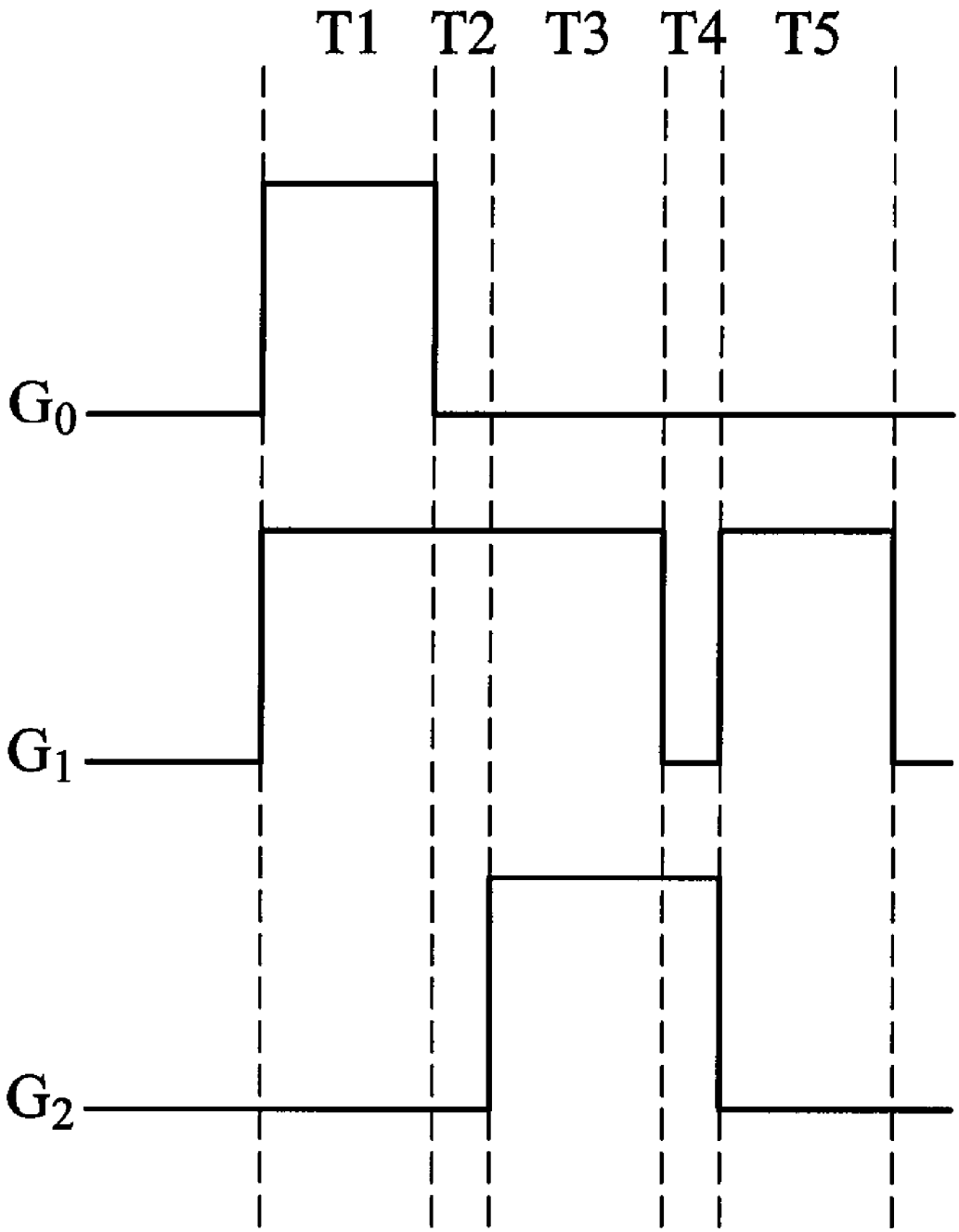
FIG. 11 is a timing diagram of an exemplary embodiment of a driving method, according to the present invention.

FIG. 11 is a timing diagram of an exemplary embodiment of a driving method for the pixel units shown in FIG. 10, which is similar to the display device in FIG. 2. The principle operation of the driving method is described as follows.

During period T1 in FIG. 11, the gate lines $G_0$ and $G_1$ are simultaneously enabled such that the storage capacitors and the liquid crystal capacitors of the pixel units 102 and 104 are charged through the source line $S_1$, and the storage capacitors and the liquid crystal capacitors of the pixel units 106 and 108 are charged through the source line $S_3$.

During period T2 in FIG. 11, the only gate line $G_1$ is enabled such that the storage capacitor and the liquid crystal capacitor of the pixel unit 102 are charged through the source line $S_1$, and the storage capacitor and the liquid crystal capacitor of the pixel unit 106 are charged through the source line $S_3$.

During period T3 in FIG. 11, the gate lines $G_1$ and $G_2$ are simultaneously enabled such that the storage capacitors and the liquid crystal capacitors of the pixel units 102, 112 and 114 are charged through the source line $S_1$, and the storage capacitors and the liquid crystal capacitors of the pixel units 106, 116, and 118 are charged through the source line $S_3$.

During period T4 in FIG. 11, the only gate line $G_2$ is enabled such that the storage capacitor and the liquid crystal capacitor of the pixel unit 112 are charged through the source line $S_1$, and the storage capacitor and the liquid crystal capacitor of the pixel unit 116 are charged through the source line $S_3$.

During period T5, the only gate line $G_1$ is enabled such that the storage capacitor and the liquid crystal capacitor of the pixel unit 102 are charged through the source line $S_1$, and the storage capacitor and the liquid crystal capacitor of the pixel unit 106 are charged through the source line $S_3$.

The storage capacitors and the liquid crystal capacitors of the pixel units 102 to 108 and 112 to 118 store voltage according to the driving method. Since the driving method involves the operations of three adjacent gate lines $G_0$~$G_3$, all the gate lines can be divided into various groups, each comprising three gate lines, such that all the storage capacitors and the liquid crystal capacitors can be charged by way of the disclosed driving method.

Since the even source lines can be omitted, the aperture ratio of the display panel of the invention increases and the number of the source driver decreases. Furthermore, more usable space on the display panel is created.

While the invention has been described by way of example and in terms of the preferred embodiments, it is to be understood that the invention is not limited to the disclosed embodiments. Rather, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A display panel, comprising:

a first row line;

a second row line parallel to the first row line;

a first column line vertical to the first and second row lines;

a first transistor comprising a first terminal, a second terminal, and a control terminal coupled to the first row line;

a second transistor comprising a first terminal coupled to the first column line, a second terminal coupled to the first terminal of the first transistor, and a control terminal coupled to the second row line;

a third row line;

a first storage capacitor coupled between the second terminal of the first transistor and the third row line; and a second storage capacitor coupled between the second terminal of the second transistor and the third row line.

2. The display panel as claimed in claim 1, wherein the first row line is a first gate line and the second row line is a second gate line.

3. The display panel as claimed in claim 1, wherein the third row line is a first common line.

4. The display panel as claimed in claim 3, further comprising:

a fourth row line parallel to the first row line;

a third transistor comprising a first terminal, a second terminal, and a control terminal coupled to the second row line; and a fourth transistor comprising a first terminal coupled to the first column line, a second terminal coupled to the first terminal of the third transistor, and a control terminal coupled to the fourth row line.

5. The display panel as claimed in claim 4, further comprising:

a fifth row line;

a third storage capacitor coupled between the second terminal of the third transistor and the fifth row line; and a fourth storage capacitor coupled between the second terminal of the fourth transistor and the fifth row line.

6. The display panel as claimed in claim 5, wherein the fifth row line is a second common line and a level of the second common line is equal to that of the first common line.

7. The display panel as claimed in claim 1, wherein the first row line is a first common line and the second row line is a gate line.

8. The display panel as claimed in claim 7, further comprising:

a first storage capacitor coupled between the second terminal of the first transistor and the first row line; and a second storage capacitor coupled between the second terminal of the second transistor and the first row line.

9. The display panel as claimed in claim 1, wherein the first column is a source line.

10. A display device, comprising:

a row driving unit for providing a first row signal and a second row signal;

a column driving unit for providing a first column signal; and a display panel comprising:

a first row line for receiving the first row signal;

a second row line, parallel to the first row line, for receiving the second row signal;

a first column line, vertical to the first and second row lines, for receiving the first column signal;

a first transistor comprising a first terminal, a second terminal, and a control terminal coupled to the first row line;

a second transistor comprising a first terminal coupled to the first column line, a second terminal coupled to the first terminal of the first transistor, and a control terminal coupled to the second row line;

a first storage capacitor coupled between the second terminal of the first transistor and the first row line; and a second storage capacitor coupled between the second terminal of the second transistor and the first row line.

11. The display device as claimed in claim 10, wherein the row driving unit comprises a common driver and a gate driver.

12. The display device as claimed in claim 11, wherein the first row signal is provided by the common driver and the second row signal is provided by the gate driver.

13. The display device as claimed in claim 10, wherein the column diving unit is a source driver.

14. The display device as claimed in claim 10, wherein the row driving unit is a gate driver.

15. The display device as claimed in claim 10, wherein the display panel further comprising:

a third row line;

a first storage capacitor coupled between the second terminal of the first transistor and the third row line; and a second storage capacitor coupled between the second terminal of the second transistor and the third row line.

16. The display device as claimed in claim 15, wherein the third row line is a first common line.

17. The display device as claimed in claim 16, wherein the display panel further comprises:

a fourth row line parallel to the first row line;

a third transistor comprising a first terminal, a second terminal, and a control terminal coupled to the second row line; and a fourth transistor comprising a first terminal coupled to the first column line, a second terminal coupled to the first terminal of the third transistor, and a control terminal coupled to the fourth row line.

18. The display device as claimed in claim 17, wherein the display panel further comprises:

a fifth row line;

a third storage capacitor coupled between the second terminal of the third transistor and the fifth row line; and a fourth storage capacitor coupled between the second terminal of the fourth transistor and the fifth row line.

19. The display device as claimed in claim 18, wherein the fifth row line is a second common line and a level of the second common line is equal to that of the first common line.

20. A pixel structure comprising:

a first row line;

a second row line parallel to the first row line;

a third row line parallel to the first row line;

a first column line vertical to the first and second row lines;

a first transistor comprising a first terminal, a second terminal, and a control terminal coupled to the first row line;

a second transistor comprising a first terminal coupled to the first column line, a second terminal coupled to the first terminal of the first transistor, and a control terminal coupled to the second row line;

a third transistor comprising a first terminal, a second terminal, and a control terminal coupled to the second row line;

a fourth transistor comprising a first terminal coupled to the first column line, a second terminal coupled to the first terminal of the third transistor, and a control terminal coupled to the third row line;

a fourth row line;

a first storage capacitor coupled between the second terminal of the first transistor and the fourth row line; and a second storage capacitor coupled between the second terminal of the second transistor and the fourth row line;

wherein during a first period, the first and second row lines are simultaneously enabled and a first data signal is transmitted to the first and second transistors through the first column line, during a second period, the second row line is enabled and a second data is transmitted to the second transistor through the first column line, during a third period, the second and third row lines are simultaneously enabled and a third data signal is transmitted to the second, third, and fourth transistors through the first column line, during a fourth period, the third row line is enabled and a fourth data is transmitted to the fourth transistor through the first column line, and during a fifth period, the second row line is enabled and a fifth data is transmitted to the second transistor through the first column line.

21. The pixel structure as claimed in claim 20, further comprising:

a fifth row line;

a third storage capacitor coupled between the second terminal of the third transistor and the fifth row line; and a fourth storage capacitor coupled between the second terminal of the fourth transistor and the fifth row line.

22. The pixel structure as claimed in claim 21, wherein during the first period, the first and second storage capacitors are charged according to the first data signal, during the second period, the second storage capacitor is charged according to the second data signal, during the third period, the second, third, and fourth storage capacitors are charged according to the third data signal, during the fourth period, the fourth storage capacitor is charged according to the fourth data signal, and during the fifth period, the second storage capacitor is charged according to the fifth data signal.

* * * * *